US006880516B2

(12) United States Patent
Maier et al.

(10) Patent No.: US 6,880,516 B2
(45) Date of Patent: Apr. 19, 2005

(54) INTAKE SYSTEM

(75) Inventors: Georg Maier, Kernen (DE); Fritz Kiesewetter, Stuttgart (DE); Andreas Bähner, Weinstadt (DE); Ralf Tuckermann, Stuttgart (DE); Axel Klimmek, Schwaikheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/759,004

(22) Filed: Jan. 20, 2004

(65) Prior Publication Data

US 2004/0144356 A1 Jul. 29, 2004

(30) Foreign Application Priority Data

Jan. 18, 2003 (DE) ..... 103 01 731

(51) Int. Cl.[7] ..... F02B 77/00

(52) U.S. Cl. ..... 123/198 E; 55/437; 55/473; 55/DIG. 28

(58) Field of Search ..... 123/198 E; 55/437, 55/473, DIG. 28

(56) References Cited

U.S. PATENT DOCUMENTS 5,485,817 A 1/1996 Dahlberg
5,632,243 A * 5/1997 Buchholz ..... 123/198 E

* cited by examiner

*Primary Examiner*—Noah P. Kamen
(74) *Attorney, Agent, or Firm*—Walter Ottesen

(57) ABSTRACT

An intake system for preparing combustion air (1) is for an internal combustion engine of a portable handheld work apparatus. The intake system includes: a carburetor (2); an air filter (3) which is connected upstream of the carburetor (2); and, a filter case (4) which closes the air filter (3) from the outside. A combustion air channel (5) leads from a take-up opening (6) in a cooling air fan (7) of the engine to an inlet opening (24) in the filter case (4). The filter case (4) includes at least one defined ventilation opening (8) for connecting an inner space (9) of the filter case (4) to the ambient air. The flow cross section of the ventilation opening (8) is so designed that the airflows through the inlet opening (24), the intake opening (18) of the carburetor (2) and the ventilation opening (8) are compensated at the rated rpm of the engine and that a uniform pressure level adjusts in the inner space (9) of the filter case (4).

20 Claims, 3 Drawing Sheets

INTAKE SYSTEM

CROSS REFERENCE TO RELATED APPLICATION

This application claims priority of German patent application no. 103 01 731.3, filed Jan. 18, 2003, the entire content of which is incorporated herein by reference.

FIELD OF THE INVENTION

The invention relates to an intake system for preparing combustion air for an internal combustion engine of a portable handheld work apparatus.

BACKGROUND OF THE INVENTION

In work apparatus such as chain saws, brushcutters, suction/blower apparatus or the like, which are driven by internal combustion engines, intake systems are provided for preparing combustion air for the engine. In the intake systems, a carburetor having a forwardly connected air filter and a filter case is mounted surrounding the air filter on the outside. The combustion airflow is drawn by the engine through the carburetor and the air filter out of the interior space of the filter case. In known arrangements, a combustion air channel is provided leading to the filter case from a discharge opening in a cooling air fan. The combustion air is branched off by means of the take-up opening from the cooling airflow moved by the cooling air fan and is made available via the combustion air channel in the interior space of the filter case for drawing in by suction through the carburetor.

In arrangements of this kind, it is, on the one hand, provided that the dynamic pressure, which is caused by the speed of the cooling airflow, leads to an increase of the air pressure of the combustion air and therefore to an increase of the engine power. On the other hand, a preseparator can be provided in the combustion air channel or, especially, in the cooling air fan in the region of the take-up opening. With this preseparator, a preseparation of foreign particles such as dust particles or the like can take place in the region of the take-up opening. In the intake system, a pre-cleaned flow of combustion air is thereby made available. The air filter, which is connected ahead of the carburetor, is subjected to a correspondingly reduced amount of dirt so that the intervals for filter exchanges can be extended which contributes to an increase of the productivity of the work apparatus. If needed, a simpler, more cost effective filter or a filter having a reduced throughflow resistance can be used because of the reduced amount of dirt.

Matching such an intake system to the operating range in question has been shown to be difficult. The stroke movement of the piston in the internal combustion engine leads to a pulsed intake airflow in the region of the carburetor while via the continuously rotating air fan, an airflow moves which is dependent upon the rpm but is essentially continuous. The interaction of the mutually opposite effects can lead to an excitation of the vibration of the air column in the combustion air channel. This, in turn, can have considerable disadvantageous effects on the intake performance in the region of the carburetor and therefore have associated negative effects on the desired uniform mixture formation. The matching of the engine and carburetor to each other as well as their matching to the design of the combustion air channel, the filter case volume or the like can be difficult. The arrangement of a compensator is complex and does not always lead to the wanted success. Especially, it can happen that a found matching functions only in a narrow operating parameter range outside of which no effective matching is given.

For avoiding such problems, U.S. Pat. No. 5,485,817 discloses an arrangement wherein a filter case has a ventilation opening which is either connected to the atmosphere or to a low pressure zone of the cooling fan. The ventilation opening is intended to avoid an excitation vibration of the air column in the combustion air channel. Here, the air channel should be so dimensioned that an underpressure or an overpressure arises in the air filter case. In order to substantially eliminate the influence of the air filter contamination on the mixture formation, it is conventional to provide a compensation connection which connects a compensation chamber of the carburetor to the clean space of the air filter. For fluctuating pressures in the air filter chamber, a compensation is, however, not possible so that the air/fuel mixture cannot be optimally adjusted.

SUMMARY OF THE INVENTION

It is an object of the invention to provide such an intake system which is improved so that it is easy to assemble and leads to an improved running performance of the engine.

The intake system of the invention is for preparing combustion air for an internal combustion engine of a portable handheld work apparatus and includes: a carburetor having an intake channel defining an intake opening; an air filter mounted upstream of the carburetor; a filter case surrounding the air filter and having an inlet opening; a cooling air fan unit of the engine for generating a flow of cooling air; a combustion air channel having a take-up inlet in the cooling air fan unit; the combustion air channel extending to the inlet opening of the filter case; the filter case having an inner space and having ventilation opening means for connecting the inner space to the ambient air; and, the ventilation opening means having a flow cross section so dimensioned that the air flows through the inlet opening, the intake opening of the carburetor and the ventilation opening are balanced at rated rpm of the engine and that a uniform pressure level adjusts in the inner space of the filter case.

The compensated pressure level permits the connection of a compensation connection to the clean space of the air filter. The compensated pressure level adjusts at least at rated rpm and especially in a wide rpm range. In these regions, the ratio of the fuel and air can thereby be optimally adjusted.

In an advantageous further embodiment, the area of the ventilation opening is matched to the volume of the interior space of the filter case and especially to the piston displacement of the engine. For usual structural sizes of internal combustion engines for handheld portable work apparatus and a corresponding design of the air filters, it has been shown that an area of the ventilation opening in the range between 100 $mm^2$ and 800 $mm^2$ is well matched. There also results especially a good matching with an area of the ventilation opening which corresponds approximately to the cross-sectional area of the intake opening of the carburetor. It has been shown that, within the matching limits set forth above, a targeted direct matching of the engine adjustment is given for a quiet and powerful engine running over the entire range of the operating parameters.

In the known arrangements, the ventilation opening to the atmosphere is arranged close to the inlet opening of the combustion air channel in the filter case. Dirt particles or the like, which enter into the filter case from the inlet opening at high velocity, are guided to a considerable extent past the ventilation opening and are drawn by suction by the carburetor to the air filter. As a consequence, an unwanted early dirtying of the air filter occurs. In order to avoid this, it is suggested to arrange the inlet opening above a ventilation opening referred to the gravity direction for a usual operating position of the work apparatus. Dust or dirt particles or the like, which are conducted with the airflow in the combustion air channel, slow their path velocity in the comparatively large volume of the filter case. Under the action of gravity, the particles can drop and (without being drawn by suction to the air filter) can reach the ambient via the ventilation opening.

It is practical to provide the ventilation opening on the lower side of the filter case. In this way, an exit of the foreign bodies under the action of gravity is possible even for an airflow through the ventilation opening which is directed slightly inwardly.

The inlet opening is advantageously arranged above the carburetor and especially above the air filter. In this way, a large path results relative to the ventilation opening. Foreign bodies whirled up by the airflow can become quiet in their path movement. Even small dust particles with slight inherent weight can drop by gravity force to the ventilation opening and reach the outside thereby reducing the load on the air filter.

In another embodiment of the invention, the cooling air fan and the take-up opening are so matched to the engine with the carburetor that at least a greater portion of the combustion air, which is drawn in by suction by the carburetor, is moved through the combustion air channel. In wide operating ranges, no or only a slight induction of combustion air through the ventilation opening takes place in the time-dependent mean of an engine cycle. Pressure fluctuations in the interior space of the filter case can be compensated via the ventilation opening. A vibration excitation of the air column in the combustion air channel is essentially avoidable. In a vibration excitation which nonetheless occurs, the arising pressure peaks are compensated via the ventilation opening. A reliable decoupling of the pulsating combustion airflow takes place in the region of the carburetor from the airflow conducted through the combustion air channel. Especially in combination with a preseparator in the region of the combustion air channel, the carburetor is thereby supplied with combustion air which is essentially pre-cleaned and is under increased pressure. In addition to a lower load on the filter, an increased engine power is also achievable. Short-time increased air requirements can be compensated by the ventilation opening without, in time average, a considerable increase of the dirt loading of the air filter taking place.

A practical matching of the suggested arrangement provides that a movement of the combustion air takes place with excess from the cooling air fan through the combustion air channel to the air filter case. In connection with a pulsating pressure in the interior space of the filter case, this matching leads to the situation that, in time average, the excess combustion air, which is not drawn in via the carburetor, exits through the ventilation opening and thereby avoids an entry of dirt particles. At high pulsation peaks, a short-term air entry can occur through the ventilation opening. The excess added combustion air leads to a scavenging function in the interior space of the filter case. In combination with the airflow, which passes in and out, however, in average exits through the ventilation opening, this leads to a scavenging removal of such dirt particles, which under the action of gravitational force, do not reach the ventilation opening. The dirt load of the air filter is additionally reduced.

In a practical further embodiment, it is provided that the combustion air channel projects with play into the inlet opening in the filter case. Position tolerances between combustion air channel and filter case can easily be compensated. This configuration is advantageous for work apparatus with an elastically suspended internal combustion engine. In such work apparatus, carburetor and filter case are rigidly connected to the apparatus and are connected, for example, via an elastic sleeve to the engine for bridging a so-called vibration gap. The combustion air channel can be configured simple, rigid and form-stable even when bridging such a vibration gap. The movement of the vibratingly mounted engine together with the combustion air channel relative to the rigidly mounted carburetor is easily compensated by the play in the region of the inlet opening.

The region of play between combustion air channel and the inlet opening can, for example, be sealed by means of an elastic membrane or the like. In an advantageous further embodiment of the invention, an ancillary ventilation opening is formed between an edge of the inlet opening and the combustion air channel projecting thereinto. The ancillary ventilation opening contributes to quieting the air movement in the filter case or, more specifically, to avoiding air vibrations. Dust particles can drop downwardly more easily in the gravity force direction from the first ventilation opening.

In an alternative practical embodiment, the combustion air channel is configured to be at least partially elastic and includes, especially, a folding bellows section. Insofar as it is wanted to connect the combustion air channel fixedly to the filter case, the swing gap can be reliably bridged via the elastic deformability of the combustion air channel.

The first ventilation opening is advantageously configured as a plurality of small openings or is configured sieve-like. For the same effectiveness relative to a single free opening, a reliable protection of the inner-lying air filter is provided against damage or penetration of dirt through the ventilation opening from the outside. It can, however, also be practical that the ventilation opening is formed as a single opening. To avoid the situation that dust reaches the air filter case through the ventilation opening, it is provided that the ventilation opening is arranged at a location having low dust loading.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
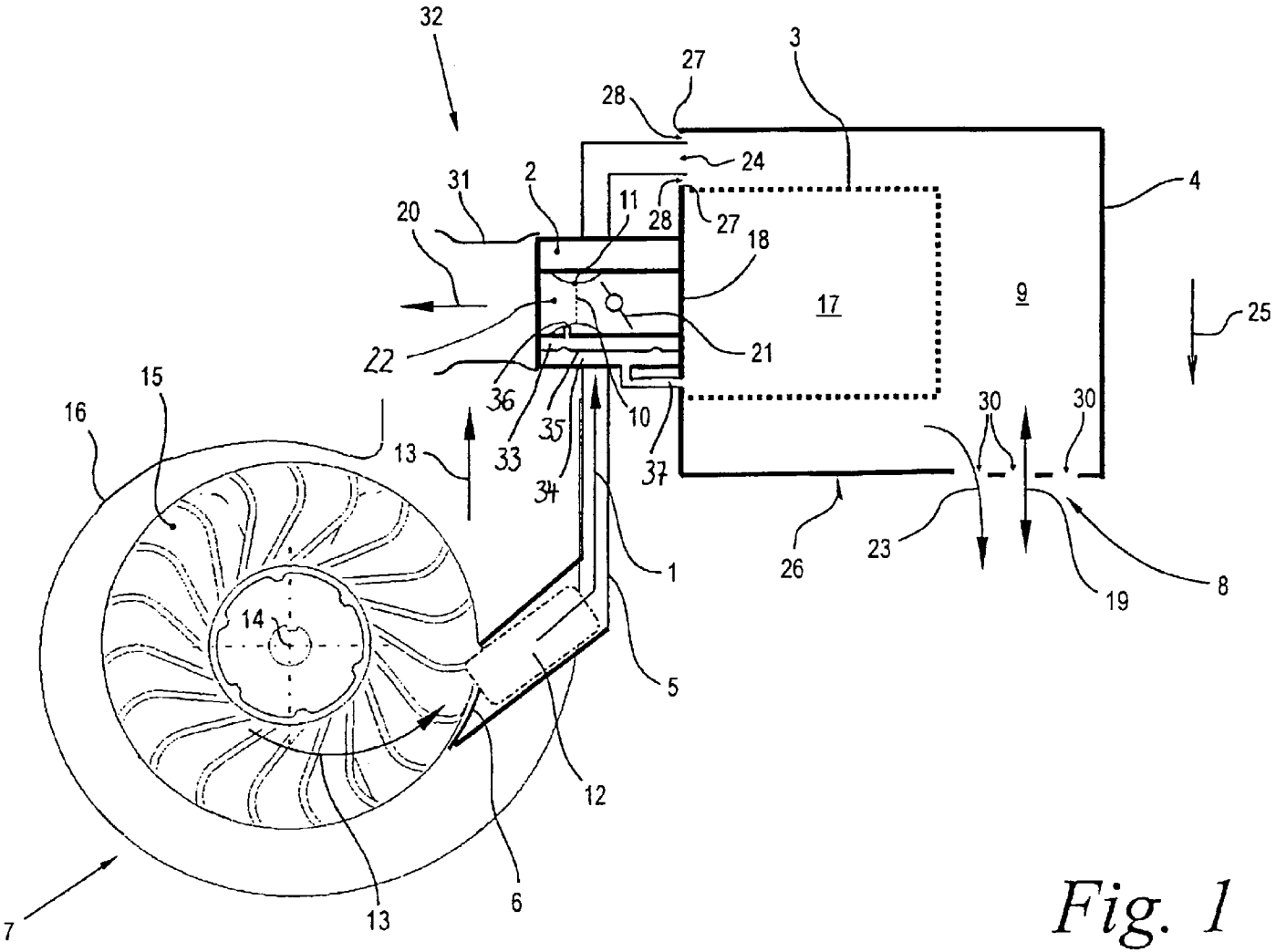
FIG. 1 is a schematic of an intake system having a combustion air channel and a ventilation opening means formed by a plurality of small openings and the combustion air channel projects with play into the inlet opening of the filter case.

FIG. 1 shows an intake system of a portable handheld work apparatus (not shown) such as a chain saw, brushcutter, suction/blower apparatus or the like. The intake system shown is for preparing combustion air for an internal combustion engine (not shown) for driving a portable handheld work apparatus. The combustion air is shown by arrow 1. The intake system includes a carburetor 2, an air filter 3 connected upstream of the carburetor 2 and a filter case 4 surrounding the air filter 3 from the outside. A swing gap 32 is formed between the carburetor 2, which is rigidly mounted on the work apparatus, and the elastically mounted engine. An elastic sleeve 31 is provided to bridge the swing gap 32 and connect the carburetor 2 to the engine.

A cooling air fan 7 is provided as part of the intake system shown and is for cooling the internal combustion engine. A combustion air channel 5 leads from a take-up opening 6 in the cooling air fan 7 to the filter case 4. In the embodiment shown, the cooling air fan 7 is configured as a radial fan having a fan wheel 15 rotatable about a rotational axis 14. The fan wheel 15 is surrounded by a spirally widening fan housing 16. A cooling air flow is moved in the direction of arrow 13 to the engine because of a rotation of the fan wheel 15.

A combustion air channel 5 leads from the cooling air fan 7 to an inlet opening 24 in the filter case 4 and opens via a take-up opening 6 in the cooling air fan 7. Combustion air 1 is branched off from the cooling air flow 13 by means of the take-up opening 6 and is conducted by means of the combustion air channel 5 into an interior space 9 of the filter case 4. The combustion air 1 is actively moved by the cooling air fan 7 and has an overpressure relative to the ambient air. The combustion air 1 enters through the inlet opening 24 approximately tangentially to the wall of the filter case 4, that is, tangentially to the surface of the air filter 3.

A preseparator 12 is mounted in the region of the take-up opening 6 for pre-cleaning the combustion air 1. With the preseparator 12, foreign materials (such as dust particles or the like), which are entrained in the cooling air flow 13, can be partially separated.

An intake channel 22 extends in the carburetor 2. A pivotable throttle flap 21 is mounted in the intake channel 22 for controlling the power of the engine and a venturi section 11 is arranged downstream of the throttle flap 21 for mixture forming. The venturi section 11 has a transverse cross-sectional area 10 indicated by a broken line. The intake channel 22 opens via an intake opening 18 into a clean air side 17 of the air filter 3 connected upstream of the carburetor. The combustion air 1, which is inducted by the engine, is taken from the inner space 9 and is drawn by suction through the air filter 3 and the clean air side 17 into the intake channel 22 and, after a successful mixture formation, is conducted to the engine in the direction of arrow 20. The carburetor 2 has a fuel chamber 33 which opens with the fuel nozzle 36 in the intake channel 22 in the region of the venturi section 11. The pressure in the fuel chamber is controlled by a control membrane 35 which is mounted between the fuel chamber 33 and a compensation chamber 34.

The compensation chamber 34 includes a compensation connection 37 which opens at the clean air side 17 of the air filter 3. The pressure in the fuel chamber 33 is controlled in dependence upon the pressure at the clean air side 17 of the air filter 3 so that the influence of the dirtying of the air filter 3 on the ratio of fuel to air in the formed mixture is substantially eliminated.

The air filter case 4 includes a defined ventilation opening 8 for connecting the inner space 9 to the ambient air. A pressure equalization, which pulsates approximately in the direction of the double arrow 19, can take place in the ventilation opening 8 to compensate for pressure fluctuations in the interior space 9. The flow cross section of the ventilation opening 8 is so designed that the airflows through the inlet opening 24, the intake opening 18 of the carburetor 2 and the ventilation opening 8 are compensated at least at rated rpm, especially in a wide rpm range of the engine so that a uniform pressure level adjusts in the interior space 9 of the filter case 4. The uniform pressure level makes possible a good compensation of the influence of the air filter contamination on the mixture formation because a pressure is present at the compensation connection 37 which is influenced only by the contamination of the air filter. The tangential inflow of the combustion air 1 into the filter case 4 makes possible the continuous further conduction of the combustion air 1 to the ventilation opening 8. The combustion air 1 flows along the surface of the air filter 3. In this way, the principle of transverse flow filtration is realized and the dust content, which is present in the inner space 9, is further reduced.

The work apparatus, that is, the components thereof which are illustrated, are shown in the usual operational position. The gravity force direction is shown by arrow 25. Referred to the gravity force direction 25, the inlet opening 24 lies above the ventilation opening 8, above the air filter 3 and therefore also above the carburetor 2. In the embodiment shown, the ventilation opening 8 is arranged at a lower side 26 of the filter case 4 and is defined by a plurality of small openings 30.

The combustion air channel 5 projects with play into the inlet opening 24. A further ventilation opening 28 is formed between an edge 27 of the inlet opening 24 and the combustion air channel 5 projecting thereinto. The region of play can be covered also by an elastic membrane or the like.

The cooling air fan 7 and the take-up opening 6 as well as also the preseparator 12 are so matched to the engine 1 with the carburetor 2 that at least an overwhelming component of the combustion air 1, which is inducted by the carburetor 2, is moved through the combustion air channel 5. The matching can be so designed that an increased requirement of combustion air 1 is adjusted by a component flow of fresh air entering through the ventilation opening 8. In the embodiment shown, the above-mentioned matching is so provided that a movement of the combustion air 1 takes place because of the cooling air fan 7 through the combustion air channel 5 with excess with reference to the flow 20 inducted by the carburetor 2. The excess combustion air 1 passes from the inner space 9 through the ventilation opening 8 in the direction of arrow 23. A pressure fluctuation or flow fluctuation, which pulsates in the direction of double arrow 19, is superposed on the outflow.

For achieving the above-mentioned matching, the area of the ventilation opening 8 is matched to the volume of the inner space 9 and also to the piston displacement of the engine. The area of the ventilation opening 8 lies in the range between 100 $mm^2$ and 800 $mm^2$. In the embodiment shown, the area corresponds approximately to the transverse cross-sectional area of the intake opening 18 of the carburetor.

Figure 2:
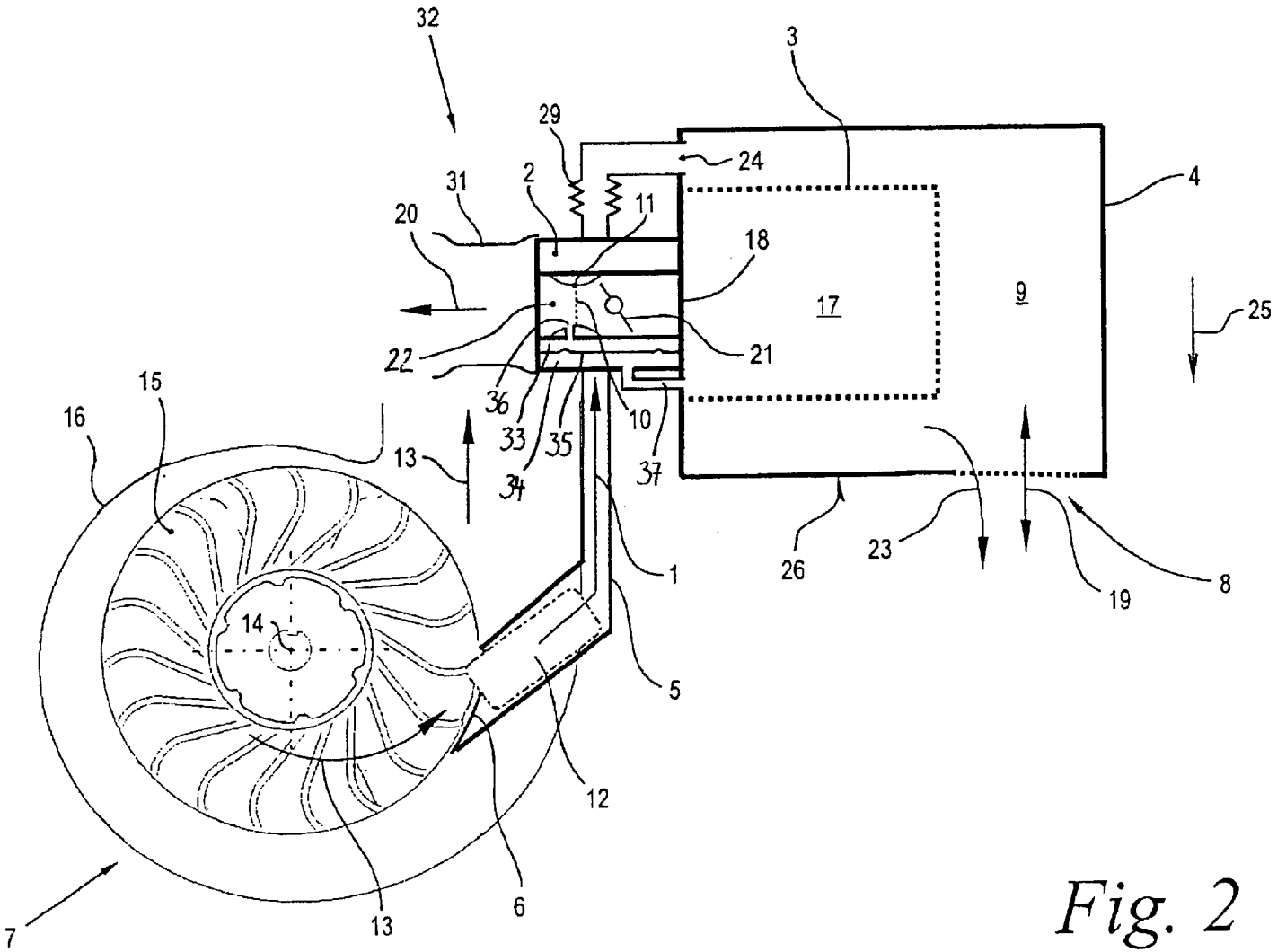
FIG. 2 is an alternate embodiment of the intake system wherein the ventilation opening means is configured as a sieve and wherein the combustion air channel includes a folding bellows section; and, FIG. 3 is another embodiment of the intake arrangement wherein the ventilation opening means is formed as a single opening.

FIG. 2 shows a variation of the arrangement of FIG. 1.

In FIG. 2, the combustion air channel 5 is configured to be partially elastic in the region of a folding bellows section 29. The combustion air channel 5 is fixedly and tightly connected to the filter case 4.

The ventilation opening 8 is configured in the manner of a sieve. The remaining features and reference characters are the same as in the arrangement of FIG. 1.

Figure 3:
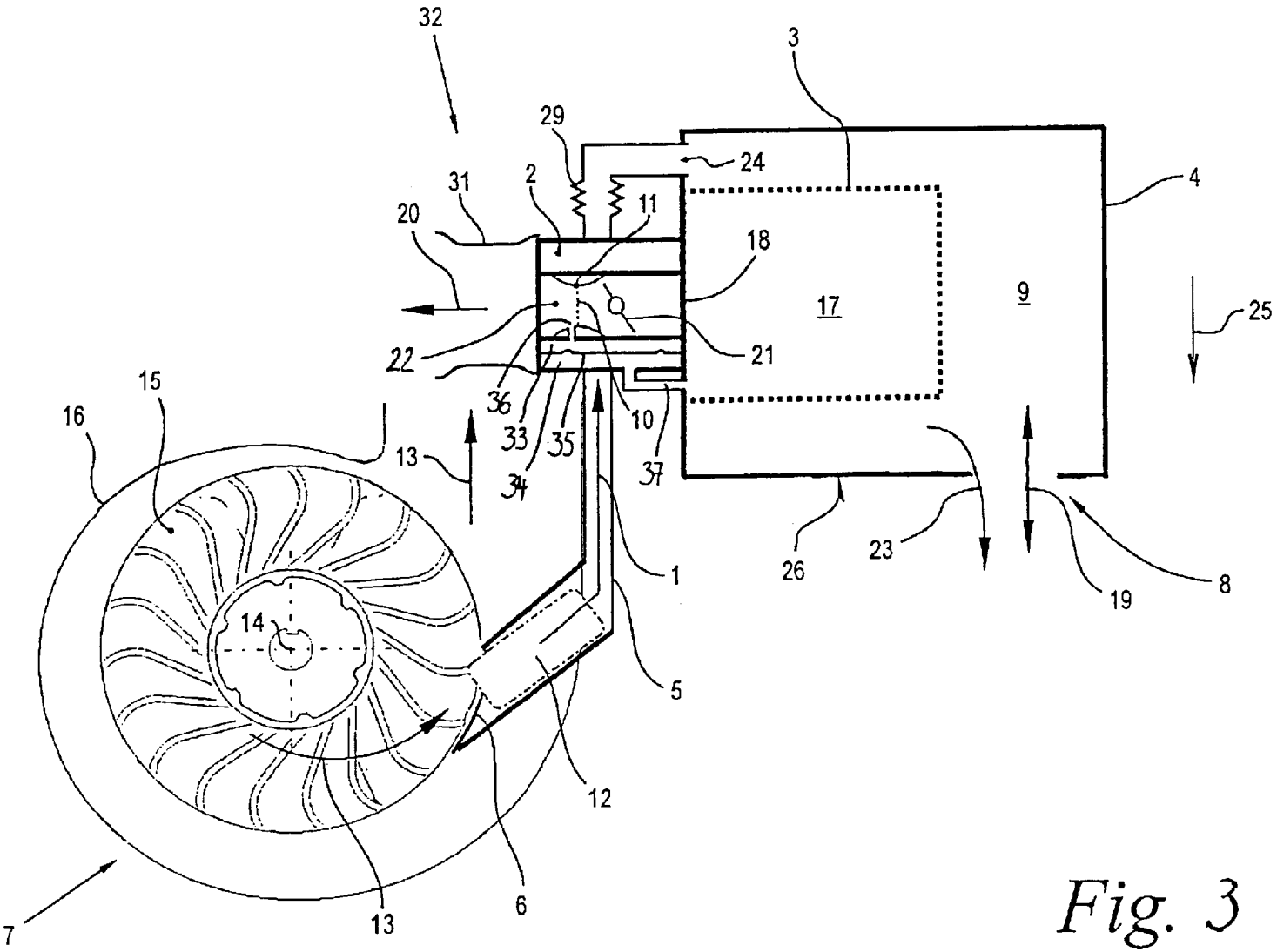

It can be practical to configure the ventilation opening 8 as a single opening as shown in FIG. 3. In order to avoid the entry of dirt through the ventilation opening 8 in the filter case 4, the ventilation opening 8 is arranged in a region of the work apparatus which is subjected to a low level of dust. The remaining features and reference numerals are the same as in the arrangement shown in FIG. 2.

It is understood that the foregoing description is that of the preferred embodiments of the invention and that various changes and modifications may be made thereto without departing from the spirit and scope of the invention as defined in the appended claims.

What is claimed is:

1. An intake system for preparing combustion air for an internal combustion engine of a portable handheld work apparatus, the intake system comprising:

a carburetor having an intake channel defining an intake opening;

an air filter mounted upstream of said carburetor;

a filter case surrounding said air filter and having an inlet opening;

a cooling air fan unit of the engine for generating a flow of cooling air;

a combustion air channel having a take-up inlet in said cooling air fan unit;

said combustion air channel extending to said inlet opening of said filter case;

said filter case having an inner space and having ventilation opening means for connecting said inner space to the ambient air; and, said ventilation opening means having a flow cross section so dimensioned that the air flows through said inlet opening, said intake opening of said carburetor and said ventilation opening means are balanced at rated rpm of said engine and that a uniform pressure level adjusts in said inner space of said filter case.

2. The intake system of claim 1, wherein the area of said ventilation opening means is matched to the volume of said filter case.

3. The intake system of claim 2, wherein said area is also matched to the piston displacement of said engine.

4. The intake system of claim 1, wherein the area of said ventilation opening means lies overall in the range of between 100 $mm^2$ and 800 $mm^2$.

5. The intake system of claim 1, wherein the area of said ventilation opening means corresponds overall approximately to the cross-sectional area of said intake opening of said carburetor.

6. The intake system of claim 1, wherein said work apparatus has a usual position in which said work apparatus is held during operation thereof; and, said inlet opening lies above said ventilation opening means when referred to the gravity-force direction for said usual position.

7. The intake system of claim 1, wherein said ventilation opening means is arranged on an underside of said filter case.

8. The intake system of claim 1, wherein said inlet opening is arranged above said carburetor.

9. The intake system of claim 8, wherein said inlet opening is arranged also above said air filter.

10. The intake system of claim 1, wherein said cooling air fan unit and said take-up opening are so matched to said engine with said carburetor that at least a greater portion of the combustion air inducted by said carburetor is moved through said combustion air channel.

11. The intake system of claim 10, wherein there is a matching for conveying the combustion air with excess.

12. The intake system of claim 1, wherein said combustion air channel projects into said inlet opening with play.

13. The intake system of claim 1, wherein said inlet opening has a peripheral edge; and, said combustion air channel and said peripheral edge conjointly define an ancillary ventilation opening.

14. The intake system of claim 1, wherein said combustion air channel is configured to be at least partially elastic.

15. The intake system of claim 1, wherein said combustion air channel has a section configured as a folding bellows section.

16. The intake system of claim 1, further comprising a preseparator mounted in the region of said take-up opening for separating out foreign particles entrained in the air flow conducted through said combustion air channel.

17. The intake system of claim 1, wherein said ventilation opening means comprises a plurality of openings.

18. The intake system of claim 1, wherein said ventilation opening means is configured as a sieve.

19. The intake system of claim 1, wherein said ventilation opening means comprises a single opening.

20. The intake system of claim 1, wherein said ventilation opening means is disposed in said filter case at a location of low dust load.

* * * * *